US005171118A

United States Patent [19]

Rothenbühler

[11] Patent Number: 5,171,118

[45] Date of Patent: Dec. 15, 1992

[54] ATTACHMENT MEMBER FOR INSULATION PANELS

[75] Inventor: Walter Rothenbühler, Gams, Switzerland

[73] Assignee: Hilti Aktiengesellschaft, Furstentum Liechtenstein, Liechtenstein

[21] Appl. No.: 812,580

[22] Filed: Dec. 20, 1991

[30] Foreign Application Priority Data

Dec. 24, 1990 [DE] Fed. Rep. of Germany ..... 4041819

[51] Int. Cl.[5] ..... F16B 15/02; F16B 43/00; E04B 5/00

[52] U.S. Cl. ..... 411/480; 411/531; 411/533; 411/923; 52/410; 52/512

[58] Field of Search ..... 411/369, 370, 440, 441, 411/480, 481, 533, 531, 923; 52/410, 512

[56] References Cited

U.S. PATENT DOCUMENTS

| | | | |
|---|---|---|---|
| 4,380,413 | 4/1983 | Dewey | 411/531 X |
| 4,757,661 | 7/1988 | Hasan | 52/410 |
| 4,884,932 | 12/1989 | Meyer | 411/533 X |
| 5,054,983 | 10/1991 | Froewis et al. | 411/531 X |
| 5,082,412 | 1/1992 | Thomas | 411/533 |

*Primary Examiner*—Neill R. Wilson

*Attorney, Agent, or Firm*—Anderson Kill Olick & Oshinsky

[57] ABSTRACT

A member (1) secured in place by a fastening element (5) attaches insulation panels (2) to a structural component (A). The fastening element (5) is driven into the structural component (A) by a setting tool (8). To prevent damage to sector-shaped parts (6) extending radially inwardly in the entrance to a passageway (4*b*) through the attachment member (1), a diametrically increased section (4*d*) of the passageway extends axially inwardly from the entrance. The diametrically increased section (4*d*) has a diameter increased by twice the thickness of the sector-shaped parts (6) compared to the adjacent inward diameter of the passageway, and an axial length at least equal to the free length of one of the sector-shaped parts (6). When the muzzle end (8*a*) of the setting tool (8) is inserted into the passageway (4*b*), the sector-shaped parts (6) are bent inwardly within the diametrically increased section (6*d*) of the passageway (4*b*) and, in combination with the passageway serve as a guide surface for the setting tool. The sector-shaped parts (6) rebound when the setting tool (8) is removed from the passageway. When a coat of plaster (9) is applied over the insulation panels and the attachment members, the plaster penetrates behind the sector-shaped parts (6) and effects a back-gripping action.

4 Claims, 4 Drawing Sheets

ATTACHMENT MEMBER FOR INSULATION PANELS

BACKGROUND OF THE INVENTION

The invention is directed to an attachment member for securing insulation panels to structural components. The attachment member includes an axially extending tubular shaft with a large area head on one end of the shaft. The head and shaft define an axially extending passageway containing an abutment for a fastening element used to secure the attachment to the structural component. The passageway has flexible sector-shaped parts located in the region of a recess in the head aligned with the passageway. The sector-shaped parts project radially inwardly toward and are arranged perpendicularly to the passageway axis.

A two-part attachment unit for securing roof insulation is disclosed in U.S. Pat. No. 4,884,932. The attachment unit includes a member with a head at one end of a shaft and the head and shaft form a passageway for receiving and holding a fastening element.

To avoid forming a passageway transmitting low temperature in the attachment member, a thermally insulating plug is pressed into the passageway through an aperture in the head. The attachment member has parts in the entrance into the passageway and these parts bend when the plug is introduced and are bent back by a stop shoulder of the plug, so that the plug cannot fall out of the passageway. The parts are formed of the same material as the attachment member.

This two-part attachment unit is used for securing insulation panels to a plywood lining or to wood or metal carriers arranged adjacent to one another. Nails are employed as the fastening elements. The attachment of insulation panels to metal supports by means of screws requires a long preparation period for the fabrication of appropriately threaded holes.

If such attachment units are covered by a coat of plaster, in the region of the entrance or aperture through the head there is no adequate adherence of the plaster. Because of the inserted plug, the plaster cannot reach behind the flexible parts and assure a back-gripping attachment. If the plug is not present in the aperture, it is not assured that the flexible parts are sufficiently returned in to their perpendicular position with respect to the passageway axis, since overstretching by the setting tool cannot be excluded. As a result, the flexible parts are not available for adherence of the plaster. Furthermore, if the plugs are not present, an amount of plaster will enter into the passageway affording a duct for the conduction of heat or cold.

SUMMARY OF THE INVENTION

Therefore, the primary object of the present invention is to provide an attachment member affording an automatic closure of the passageway through the member after it has been secured in place and assuring the securement of a coat of plaster in the region of the passageway even if a setting tool extending into the passageway is used.

In accordance with the present invention, the passageway through the attachment member has an axially extending increased diameter section extending from the head region where the increase in diameter is at least twice the wall thickness of one sector-shaped part as compared to the diameter of the passageway inwardly of the enlarged diameter section. In addition, the axial extent of the increased diameter section corresponds at least to the free length of one of the sector-shaped parts.

With this arrangement it is assured, even if a setting tool is used for the fastening element, that there is no harmful stressing of the sector-shaped parts. Accordingly, the mouth or muzzle of the setting tool, inserted into the passageway, can be centered, whereby it is positioned in the center of the passageway. When the setting tool is inserted, the sector-shaped parts are bent inwardly and bear against the surface of the increased diameter section. The surfaces of the bent sector-shaped parts facing the center of the attachment member form an extension of the passageway and an axial extension of the guidance region for the muzzle of the setting tool.

Preferably, the increased diameter section has chamfers spaced apart in the circumferential direction forming a lead-in at the head region of the attachment member. These chamfers facilitate the insertion and centering of the setting tool.

A distinguishing feature of the invention is a recessed part of the head carrying the connections of the sector-shaped parts which extend radially inwardly from the connections. With this arrangement it is possible to locate the bending edge of the sector-shaped parts in the region of the connection affording a larger bending radius. The elasticity of the sector-shaped part is maintained. In particular, where the sector-shaped parts are formed of a plastics material, there is the danger with an excessively sharp edge in the bending region that damage to the parts may occur.

The beveled faces of the chamfers in the region of the entrance into the passageway through the attachment member extend tangentially to the bending edge near the center of the bent segment-shaped parts. If the setting tool is inserted in an eccentric manner, the tool muzzle slides over the inclined or beveled faces of the chamfers and subsequently over the bent edge of at least one bent segment-shaped part into a centered position.

Advantageously, the connections of the sector-shaped parts follow next to the circumferentially spaced chamfers at the lead-in to the enlarged or increased diameter section of the passageway. Accordingly, a preliminary centering of the setting tool muzzle is achieved by the chamfers and shearing of the sector-shaped parts is prevented.

The sector-shaped parts have a rated bending location in the form of a cross-sectional constriction. This arrangement affords an equal bending of all the sector-shaped parts. The cross-sectional constriction is obtained by a reduction in the circumferential width of the sector-shaped parts in the region of the connections to the head while the thickness of the parts is maintained. By reducing the length of the bending location, improved bending of the sector-shaped parts is achieved.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
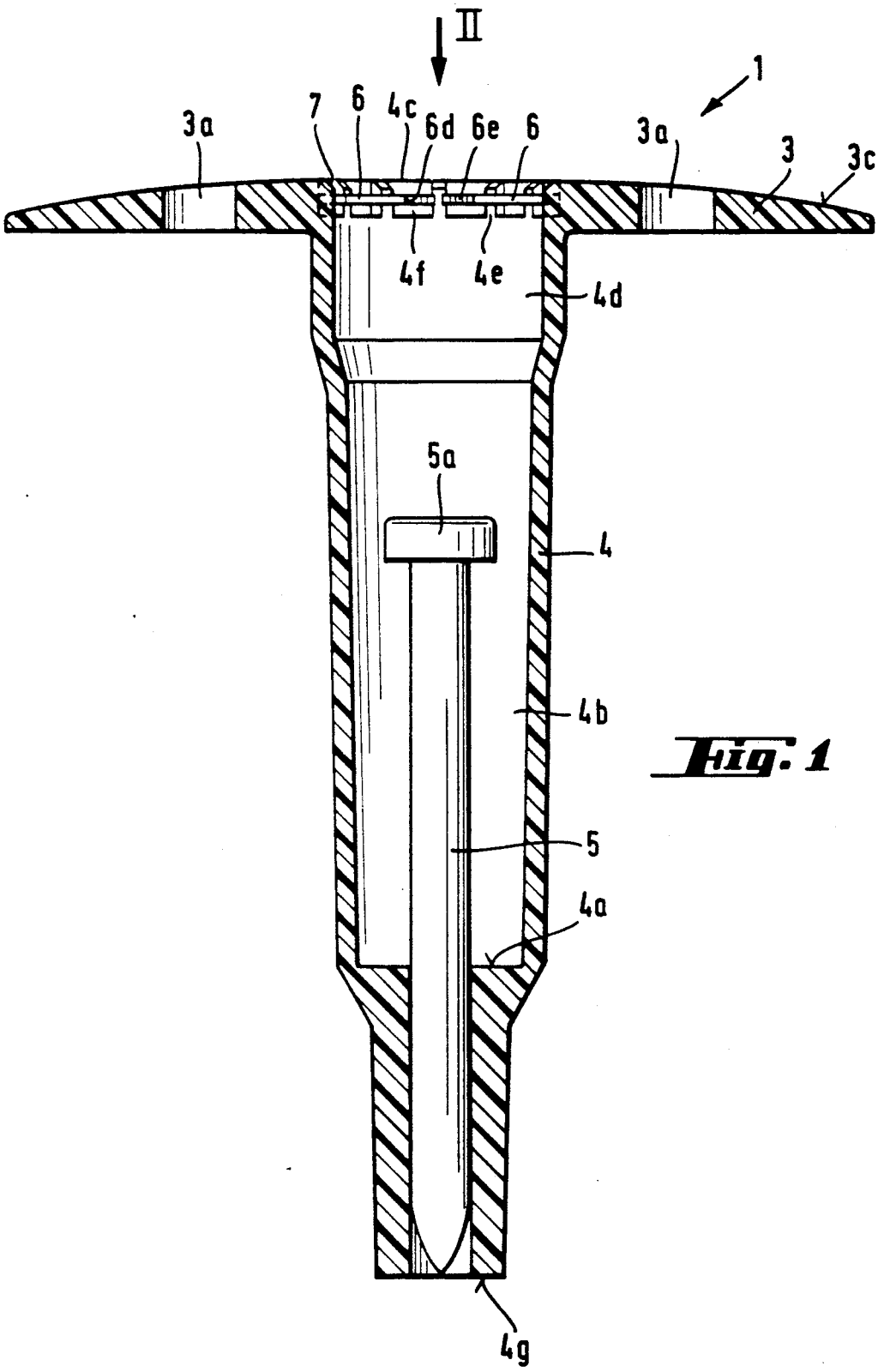
FIG. 1 is an axially extending sectional view of the attachment member and fastening element taken along the line I—I in FIG. 2.

An axially extending attachment member 1 is shown in FIG. 1 and the member includes a large area head 3 extending transversely outwardly from a tubular shank 4. The head 3 and shaft 4 define an axially extending passageway 4b. The attachment member has a leading end at the lower end in FIG. 1 and a trailing end where the head 3 projects outwardly from the trailing end of the shaft 4. In the passageway 4b, spaced inwardly from the leading end, there is an abutment 4a for a fastening element 5, note FIG. 5. The fastening element 5 is a nail or bolt used to secure the attachment member 1 to the structural component A, note FIGS. 4 and 5.

Figure 2:
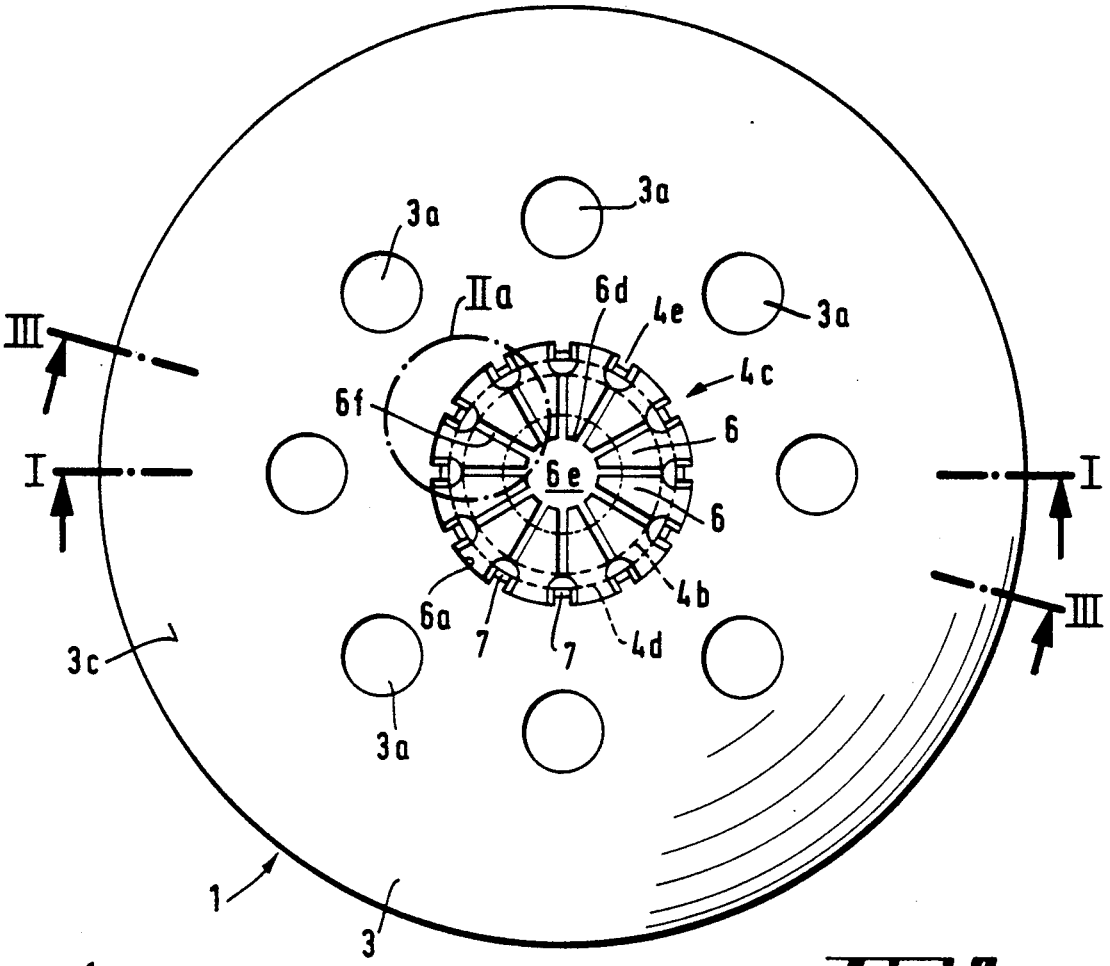
FIG. 2 is an enlarged top view of the attachment member taken in the direction of the arrow II in FIG. II.
Figure 2A:
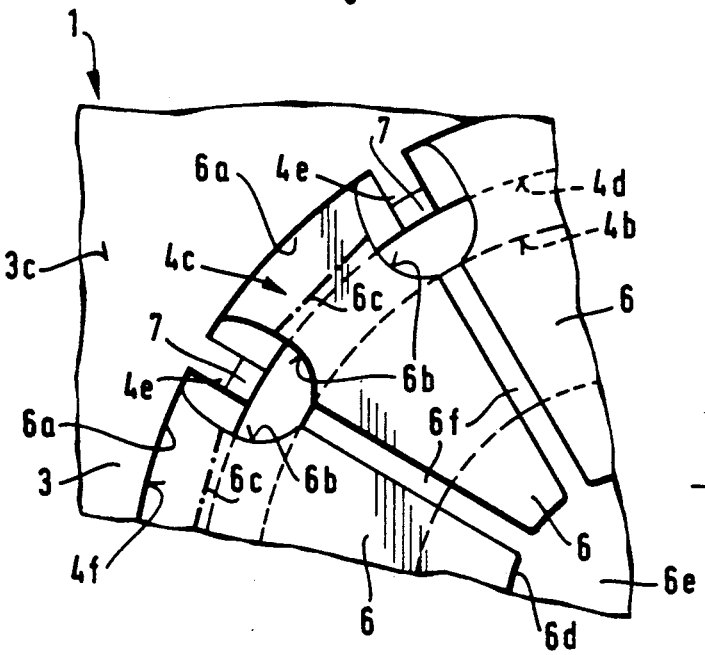
FIG. 2a is a further enlarged partial top view of the attachment member in FIG. 2 displaying the connection of a sector-shaped part to the attachment member.
Figure 3:
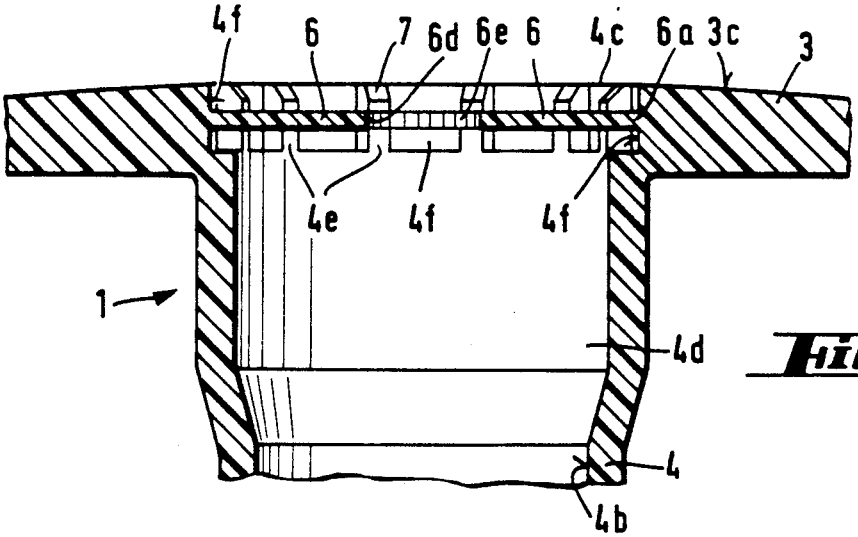
FIG. 3 is an enlarged partial axial sectional view of the attachment member with sector-shaped parts projecting inwardly toward the center of the attachment member and viewed along the line III—III in FIG. 2.
Figure 5:
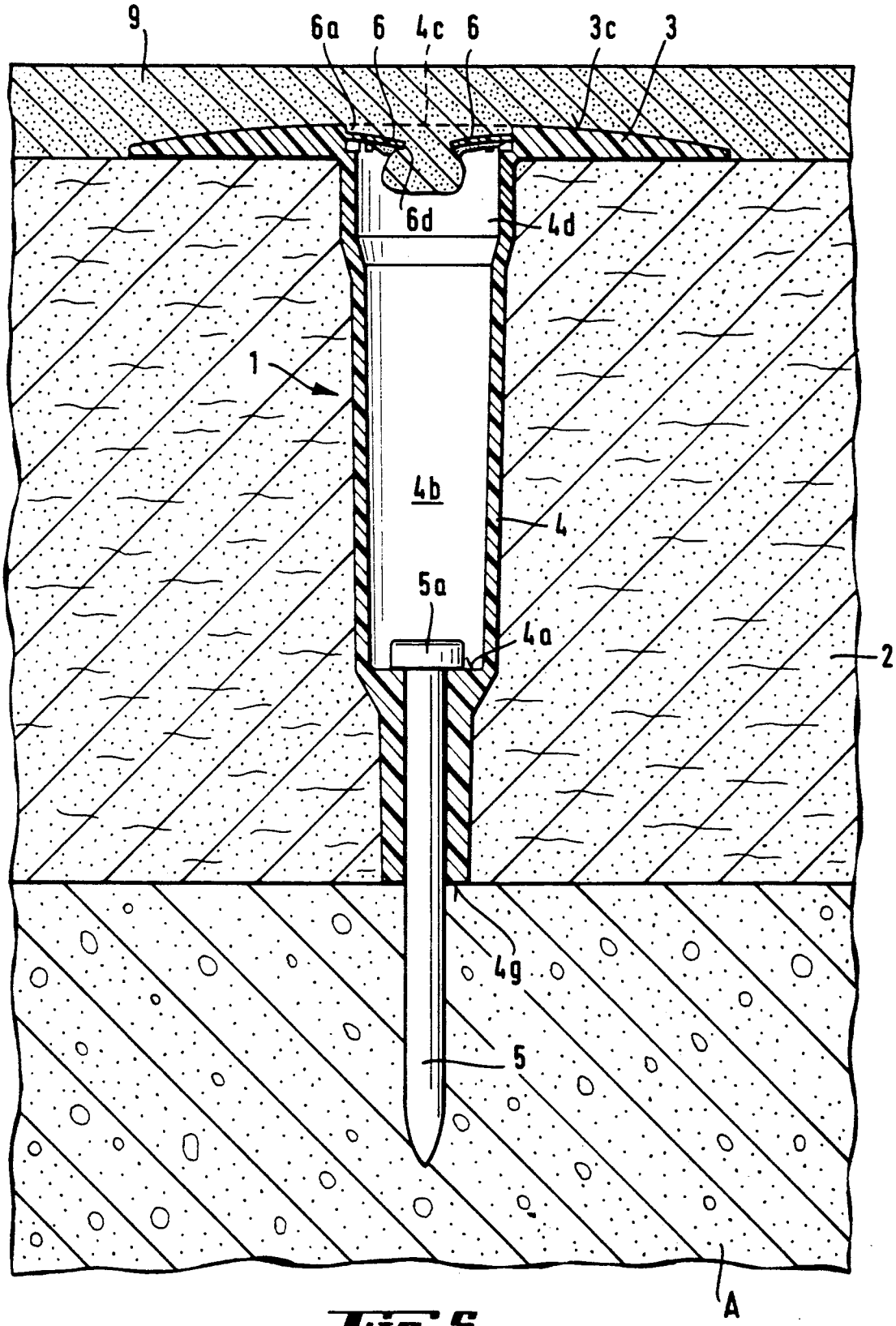
FIG. 5 is an axially extending sectional view of the attachment member and the fastening element in the inserted position.

Spaced radially outwardly from the passageway 4b are bores 3a extending through the head 3 in the axial direction of the shaft 4. Passageway 4b has an entrance region 4c in the region of the head 3 and a plurality of flexible sector-shaped parts 6 project from the head toward the center or axis of the passageway 4b. FIG. 2 and, in particular, FIG. 2a illustrate an enlarged portion of the sector-shaped parts 6. While maintaining the thickness or axial dimension of the sector-shaped parts constant, a reduction in cross section of the parts is provided along the length or circumferential dimension of the bending line 6c of the parts. This reduction is obtained by concave cutouts 6b spaced apart in the circumferential direction and located between adjacent sector-shaped parts. As shown in FIGS. 1 and 3, the sector-shaped parts 6 are recessed axially inwardly from the outer surface of the head 3 within a radially extending annular recess 4f at the upper end, as viewed in FIGS. 1 and 3, of an enlarged or increased diameter section 4d of the passageway 4b. Residual webs 4e are produced when forming the recesses 4f and define an extension of the increased diameter section 4d. As shown in FIG. 5, a plaster material 9 can flow into the bores 3a located in the head 3 of the attachment member 1. Due to the cylindrical shape of the bores 3a, the plug of the plaster 9 hardens therein and is also cylindrical. The relatively large cross section of such plugs can carry the higher shear forces produced by the weight of the coat of plaster 9.

In FIG. 3 the entrance 4c into the increased diameter section 4d is shown. The recesses 4f extend radially outwardly from the entrance 4c and contain the connections 6a of the sector-shaped parts 6 to the head 3. From the connections 6a the parts 6 extend radially inwardly toward the center or axis of the passageway 4b. Increased diameter section 4d has an axial dimension corresponding essentially to the radial or free length dimension of one of the sector-shaped parts. Each of connections 6a of the sector-shaped parts 6 in the corresponding recesses 4f are located in the circumferential direction between two spaced chamfers 7 located radially inwardly on the webs 4e. Since the sector-shaped parts 6 do not extend completely to the center or axis of the passageway 4b the somewhat pointed inner ends 6d of the parts define a circular aperture 6e.

Figure 4:
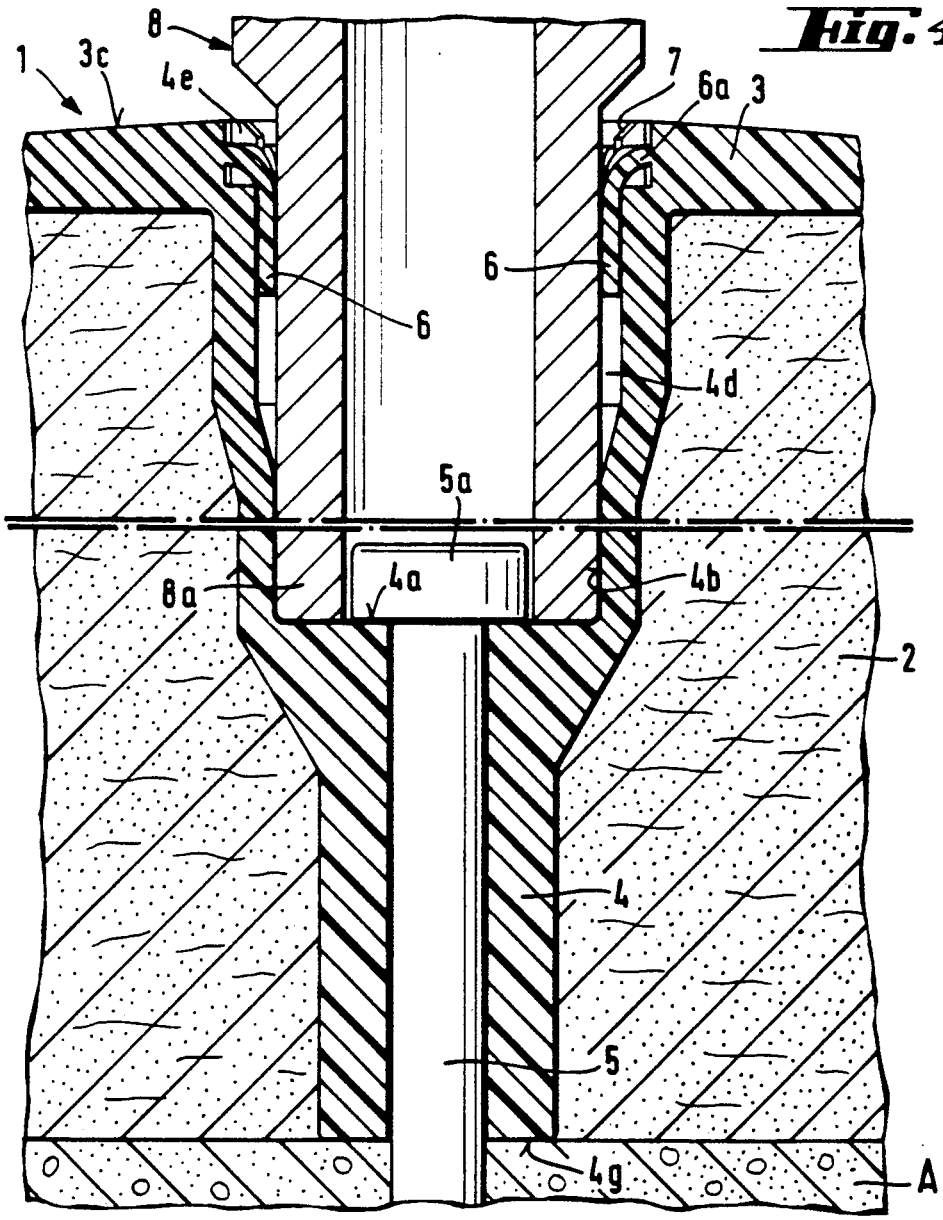
FIG. 4 is an enlarged partial axial sectional view of the attachment member with the muzzle of a setting tool extending into the passageway through the attachment member and with the fastening, element in the inserted position.

The insertion and securement of an attachment member 1 is set forth in FIG. 4. The shaft 4 of the attachment member 1 extends completely through an insulation panel 2 and abuts with its leading end face 4g against the surface of a structural component A over which the insulation panel extends. The attachment member 1 is retained by the fastening element 5 in the form of a bolt or nail driven by the setting tool 8 into the component A. The muzzle 8a of the setting tool 8 is positioned within the passageway 4b of the attachment and bears against the abutment 4a within the passageway. As the muzzle 8a of the setting tool 8 is inserted, the sector-shaped parts 6 are bent inwardly and are located between the outer surface of the muzzle 8a and the increased diameter section 4d of the passageway 4b. As a result, the guidance region for the muzzle 8a of the setting tool 8 extends through the passageway 4b and the increased diameter section 4d of the passageway. As a result, damage to the sector-shaped parts 6 is prevented.

FIG. 5 shows an attachment member 1 secured by a fastening element 5 to the component A. The fastening element 5 is driven into the component A, which as shown is formed of concrete, by a known setting tool 8, shown only in part in FIG. 4. After withdrawing the muzzle 8a of the setting tool 8 out of the passageway 4b, the flexible sector-shaped parts 6 rebound into the original position as shown in FIG. 1 and assume a final position bent slightly inwardly in the axial direction of the passageway 4d. When a coat of plaster 9 is subsequently applied, the plaster penetrates into the gaps between adjacent sector-shaped parts 6 and through the central aperture 6e and reaches behind or inwardly of the sector-shaped parts, note FIG. 5. When the coat of plaster 9 dries a back-gripping attachment is developed in the region of the sector-shaped parts 6. The air trapped in the passageway 4b, between the abutment 4a for the head 5a of the fastening element 5 and the sector-shaped parts 6 serves as heat insulation.

While specific embodiments of the invention have been shown and described in detail to illustrate the application of the inventive principles, it will be understood that the invention may be embodied otherwise without departing from such principles.

I claim:

1. Attachment member for use in securing insulation panels (2) to a structural component (A) comprising an axially extending tubular shaft (4) having a first end and a second end spaced apart in the axial direction, a large area annular head (3) secured to the first end of said shaft (4) and extending transversely of the axial direction radially outwardly from the shaft, said head (3) and shaft (4) define an axially extending passageway (4b) having a first diameter located intermediate the first and second ends of said shaft, said shaft having an abutment therein extending transversely of the axial direction and stepped radially inwardly from the first diameter, said abutment arranged as a stop for a fastening element (5) used for fixing the attachment member (1) to the structural component (A), and flexible sector-shaped parts (6) located in said passageway in the axial region of said head (3) and extending radially inwardly from said head, said sector-shaped parts (6) extend perpendicularly to and radially inwardly toward the axis of said shaft and have a thickness extending in the axial direction of said shaft, wherein the improvement comprises that said passageway (4*b*) extending from said head (3) and the first end of said shaft (4) has an axially extending section (4*d*) with an enlarged diameter increased by at least twice the thickness of one of said sector-shaped parts (6) as compared to said first diameter and said section (4*d*) has an axial length equal to at least a free length of one of said sector-shaped parts, and the axially extending increased diameter section in the axial region of said head has chamfers (7) widening in the direction from the first end of said shaft (4) toward said head (3).

2. Attachment member, as set forth in claim 1, wherein the axially extending increased diameter section (4*d*) in the axially extending region of said head (3) has circumferentially spaced recesses (4*f*) extending radially outwardly from the axially extending increased diameter section (4*d*) and containing connections (6*a*) for the sector-shaped parts (6) to said head (3).

3. Attachment member, as set forth in claim 2, wherein the connections (6*a*) of said sector-shaped parts (6) are separated in the circumferential direction by said chamfers (7).

4. Attachment member, as set forth in claim 2, wherein said sector-shaped parts (6) have a circumferentially extending bending line 6*c* located between cross-sectional constrictions (6*b*) in said sector-shaped parts reducing the circumferential dimension of said parts with said constrictions (6*b*) located adjacent said head (3).

* * * * *